United States Patent [19]

Ito et al.

[11] Patent Number: 4,547,975

[45] Date of Patent: Oct. 22, 1985

[54] METHOD AND APPARATUS FOR ADJUSTING THE QUANTITY OF WATER DEPOSITED ON A FINE AGGREGATE

[75] Inventors: Yasuro Ito; Yoshiro Higuchi, both of Tokyo; Seiichi Aida, Chiba, all of Japan

[73] Assignees: Yasuro Ito; Taisei Corporation, both of Tokyo, Japan

[21] Appl. No.: 577,798

[22] Filed: Feb. 7, 1984

[30] Foreign Application Priority Data

Sep. 13, 1983 [JP] Japan ..... 58-167513
Sep. 21, 1983 [JP] Japan ..... 58-145042[U]

[51] Int. Cl.[4] ..... F26B 5/08

[52] U.S. Cl. ..... 34/8; 34/58; 34/59; 34/178; 209/49; 210/801; 366/297

[58] Field of Search ..... 34/8, 58, 59, 165, 178, 34/179, 171, 173; 209/45, 49; 210/770, 787, 801; 366/292, 297, 299

[56] References Cited

U.S. PATENT DOCUMENTS 799,407 9/1905 Schneible ..... 366/297
3,517,889 6/1970 Farmer ..... 209/45
4,384,787 5/1983 Ito et al. ..... 366/65

*Primary Examiner*—Larry I. Schwartz
*Attorney, Agent, or Firm*—Birch, Stewart, Kolasch & Birch

[57] ABSTRACT

A quantity of water deposited on sand particles is adjusted to a predetermined value by utilizing a method and apparatus disclosed having a hopper through which the sand particles to be treated are supplied. A velocity energy is imparted to the particles to project them in a predetermined direction, thereby causing the particles to collide against rotating drums. As a result of the collision, a portion of a quantity of water initially deposited on the particles is removed therefrom and transferred to the drums, which is thereafter separated from the drums by a centrifugal force created by rotation of the drums. A plurality of notches or slits may be formed to axially extend along the periphery of the drums so that the deposited water moving along the periphery will tend into contact with be separated therefrom when it comes to one of the notches or slits. An air jet stream passing through the respective slits to the outside will function to facilitate the water removal from the periphery of the drums. Alternatively or in combination therewith, nozzle means may be provided for scraping or absorbing the deposited water from the drums.

21 Claims, 17 Drawing Figures

METHOD AND APPARATUS FOR ADJUSTING THE QUANTITY OF WATER DEPOSITED ON A FINE AGGREGATE

BACKGROUND OF THE INVENTION

The present invention relates to a method and apparatus for adjusting the quantity of water deposited on fine aggregate to be used for preparing mortar or concrete mixture.

Fine aggregate such as river or mountain sand are widely used to prepare mortar or concrete and thereby construct buildings or many other structures. As is well known, the fine aggregates are generally stored in the outdoor and often subjected to rain, dew or snow so that the water quantity deposited thereon varies greatly and can not be controlled.

When preparing mortar or concrete using the fine aggregate as well as a powder of hydraulic substance (e.g. cement) and water, it is essential to definitely determine various ratios of a resulting mixture, such as water to cement ratio (W/C) and cement to sand ratio (C/S), which ratios have a great influence upon the characteristics of the resulting mixture. However, these ratios cannot be determined unless the water quantity deposited on the surface of particles of fine aggregate to be actually used is exactly recognized.

U.S. Pat. No. 4,384,787 discloses a method and apparatus for adjusting the quantity of liquid adhered to fine particles wherein an impact force larger than the adhesive force of the liquid is applied to the particles. However, it was not definitely clarified how the quantity of liquid is separated from the particles by applying the impact force, thereby making it impossible to constantly obtain favorable results. Moreover, the use of an impact body with which the particles are intended to collide is continuously subjected to abrasion, whereby the impact body can not be used for a long period of time and therefore will frequently require mending and exchanging.

SUMMARY OF THE INVENTION

It is therefore an object of the present invention to provide an improved method and apparatus for adjusting the quantity of water deposited on particles of fine aggregate, which is capable of constantly obtaining satisfactory results.

Another object of the present invention is to provide an apparatus for adjusting the water quantity deposited on particles of fine aggregate, which has improved durability of use.

According to one aspect of the present invention there is provided an apparatus for adjusting the quantity of water deposited on particles of fine aggregate comprising means for supplying the particles having a quantity of initial surface water larger than a predetermined quantity; means for imparting a velocity energy to the particles to project the particles in a predetermined direction; one or more of rotating cylindrical members arranged such that the particles projected in the predetermined direction are caused to collide thereagainst, thereby removing a portion of the quantity of the initial surface water from the particles to the cylindrical members, said portion of the quantity of the initial surface water transferred to the cylindrical members being removed therefrom by centrifugal force created by the rotation of the cylindrical members; and means for recovering the treated particles having a uniform and optimum quantity of surface water.

According to the present invention an impact force is utilized for adjusting the quantity of water deposited on particles of fine aggregate such as sand. More particularly, the sand particles are projected against a collision wall and as a result, a quantity of water deposited on the sand particles are transferred to the collision wall. The quantity of water removed from the sand particles to the collision wall depends upon the quantity of water initially deposited on the sand particles and the impact force applied thereto. It has been practically confirmed that when sand particles have an initial surface water quantity larger than a predetermined value, the water quantity remaining on the sand particles is adjusted to a value proportional to the impact force. Thus, the water quantity remaining on the sand particles can be adjusted by controlling the impact force applied thereto.

Moreover, the impact force treatment will also be effective to uniformly moisten the sand particles. More particularly, during the projection of a sand particle (11), due to air resistance, the deposited water (12) is moved along the periphery of the particles in the reverse direction of the projection and adheres to the particle (11) on one side thereof opposite to the collision wall (13) as shown in FIG. 1(A). As a result of the collision the deposited water (12) is moved in the direction of the arrows shown in FIG. 1(B) and a substantial portion of the deposited water (12) is separated from the particle (11). Thus, the entire surface of the particle (11) will be uniformly covered by a very thin water film.

The impact body against which the sand particles are projected to collide comprises one or more rotary members in the form of a cylindrical drum, which has improved durability. When a large quantity of sand particle are projected at a high speed against a plane surface, the surface tends to be damaged and deformed by the repeated collision with the sand particles, thereby making it difficult to maintain the uniform result of the quantity of water remaining on the sand particles after collision. Such a disadvantage can be avoided, according to the present invention by using a rotary drum which will be uniformly damaged by the collision throughout the entire surface, thereby maintaining a constant effect of water removed from the sand particles. A quantity of water which has been separated from the sand particles would remain for a while on the drum but can be soon removed therefrom by utilizing a centrifugal force created by the rotation of the drum, as well as gravity.

A plurality of notches or slits are formed on the drums extending substantially along the axial direction thereof, in which case the water deposited on the periphery of the drum is more effectively removed. The water deposited on the rotating drum will move around the periphery but can soon be separated therefrom when the water reaches any one of the notches or slits. The water separation effect can be achieved also when an air flow condition is established at the periphery of the drum. These means can be simultaneously used in a single apparatus, resulting in an improved water separation effect.

BRIEF DESCRIPTION OF THE DRAWINGS

Further objects and advantages of the present invention can be fully understood from the following detailed description when read in conjunction with the accompanying drawings in which.

PREFERRED EMBODIMENTS OF THE INVENTION

Figure 1A:
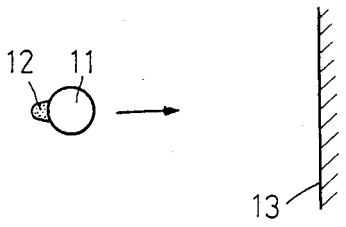
FIGS. 1A and 1B are an explanatory view showing the state of deposition of surface water on a sand particle when the particle is projected in the air and when the particle is caused to collide against a wall.
Figure 1B:
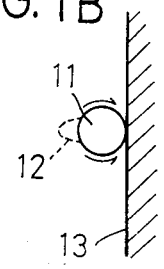
Figure 2:
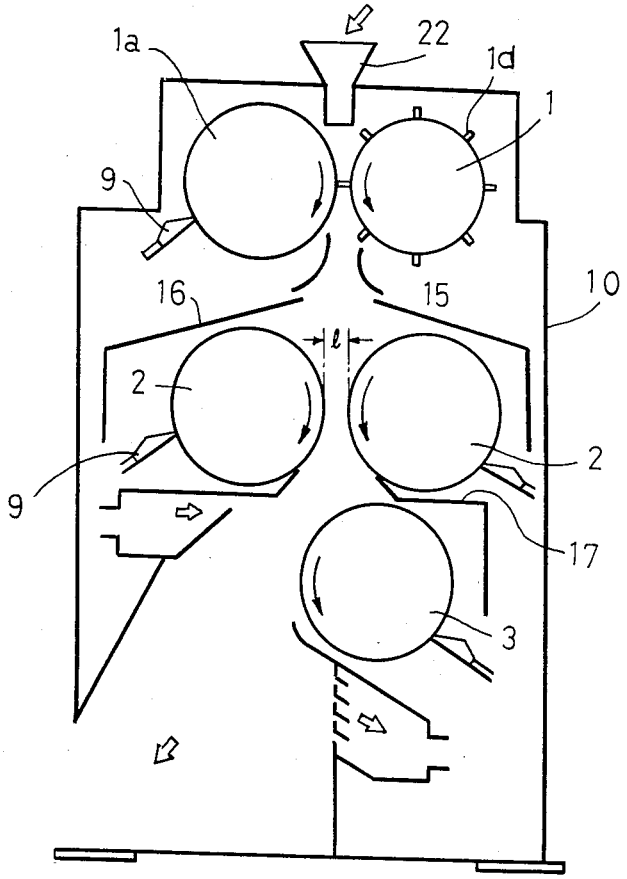
FIG. 2 is an explanatory sectional view showing one embodiment of the water separator according to the present invention.

Referring specifically to FIG. 2 showing an embodiment of the water separator according to the present invention, a hopper (22) for receiving particles of fine aggregate to be treated is provided at the top portion of housing (10). Beneath the hopper (22) is symmetrically arranged a pair of rotary drums (1, 1*a*), which are rotated in a direction opposited to each other to impact a velocity energy to the sand particles introduced within the housing (10) and thereby project downwardly the entire quantity of sand particles. At least one (1) of the drums (1, 1*a*) must function for the above described purpose and thus is provided with a plurality of radial vanes (1*d*). Such radial vanes (1*d*) may be omitted from the other drum (1*a*) which may be simply rotated to supplement the effect of drum (1).

A pair of main impact drums (2, 2) are disposed in the middle section of the housing (10) and beneath the pair of drum (1, 1*a*), which are also rotated in an opposite direction with respect to each other. Guide walls (15, 16) are positioned between the drums (1, 1*a*) and main drums (2,2) so that the particles projected from the drums (1,1*a*) can be properly guided to fall downwardly and caused to collide against the main drums (2,2). Elements other then the particles, such as water drops which may have separated from the particles by the drums (1,1*a*), are prevented from entering the middle section by the guide walls (15,16). At the lower portion of the housing (10) is provided an auxiliary impact drum (3) so that a portion of the particles which may possibly fall downwardly through the space (l) between the rotary drums (2,2) without colliding with the drums (2,2) will be supplementarily subjected to the water separation treatment. A partition wall (17) is disposed for guiding a quantity of water which has been separated at the drum (2) to the outside and for preventing the same from being directed toward the auxiliary drum (3). The space (l) should be as small as possible but should be sufficiently large to permit the particles to pass therethrough. In general, the interval (l) is 2 or 3 to 5 mm.

Figure 3:
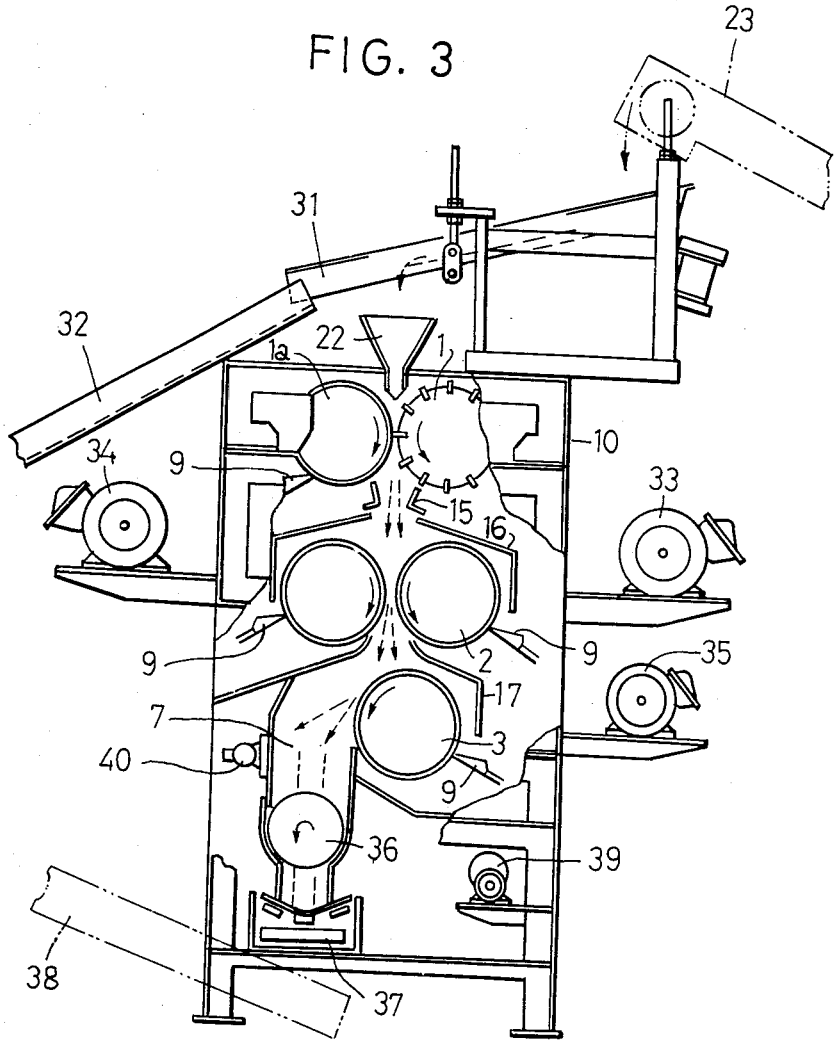
FIG. 3 is a longitudinal sectional view showing one example of a practical installation including the water separator substantially shown in FIG. 2.

FIG. 3 shows one example of a practical construction utilizing the water separator of FIG. 2 but containing a slight modification at the lower portion thereof. More particularly, the particles of fine aggregate are continuously conveyed to the hopper (22) via a belt conveyor (23) and a feeder (31). Impurities are removed by a chute (32) to the outside. Driving means such as electric motors (33) (34) and (35) are provided in the outside of the housing (10) for rotating the drums (1,1*a*, 2, 3), respectively. At the lower portion of the housing, slightly different from that shown in FIG. 2, a discharge rotor (36) driven by a motor (39) and a discharge conveyor (37) are disposed for discharging the particles from which a quantity of water has been separated. The particles thus discharged are collected and delivered to a working station, for example (not shown) by means of a belt conveyor (38). A vibromotor (40) is preferably attached to a side wall (7) surrounding the discharge path of particles for vibrating the side wall (7) to remove the particles deposited on the inner surface of the wall (7).

As described above, it is essential to remove the water deposited on the surfaces of the drums. For the purpose, the embodiment of FIG. 2 or 3 is provided with nozzles (9) for the respective drums (1*a*, 2, 2, 3), each nozzle ejecting air against the drum at a position on the drum substantially opposite to the falling path of the particles as shown. It is preferable to substantially tangentially direct the air jet from the nozzle (9) to the drum, thereby producing no resistance to the drum rotation and preventing abrasion of the drum. Of course, a plurality of nozzles may be provided for each drum.

Figure 4:
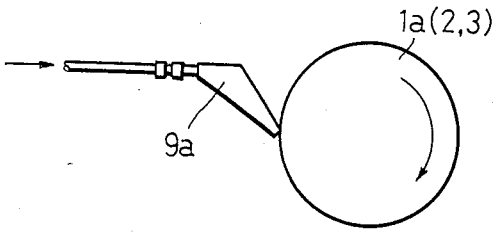
FIG. 4 is an explanatory view showing a manner of ejecting air against the rotating drum by means of the nozzle shown in FIG. 2 or 3 which is designed as an air blower.
Figure 5:
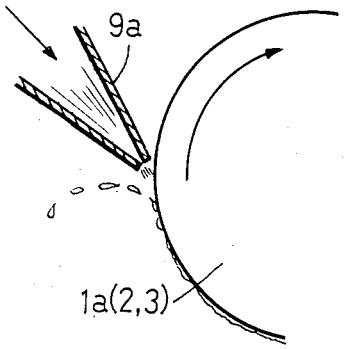
FIG. 5 is an enlarged explanatory view showing a manner of removing water deposited on the drum by the air ejected from the blower shown in FIG. 4.
Figure 6:
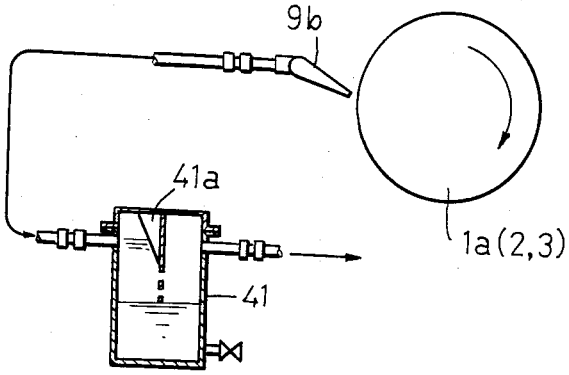
FIGS. 6 and 7 are explanatory views showing a manner of removing water deposited on a drum by utilizing air inhaled by a suction nozzle, which may be the nozzle shown in FIG. 2 or 3 or a modified nozzle as shown in FIGS. 4 and 5.
Figure 7:
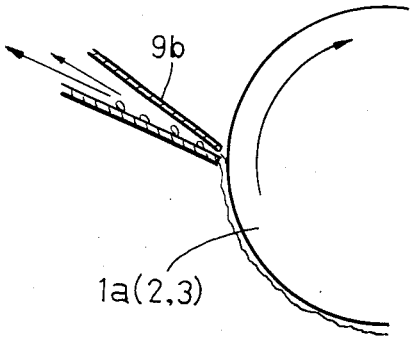

The nozzle (9) may comprise an air blower (9*a*) as shown in FIGS. 4 and 5, or a suction nozzle (9*b*) as shown in FIGS. 6 and 7. More particularly, the blower (9*a*) will act as a scraper as shown in FIG. 5 so that the water separated from the particles but remaining on the drum can be effectively removed from the drum to fall downwardly with gravity while being guided by the guide walls (15, 16, 17). On the contrary, where the suction nozzle (9*b*) is used, air containing the separated water is absorbed into the nozzle (9*b*) and caused to collide against a wall (41*a*) of a reservoir (41), the water being collected in the reservoir with only the air being transferred to the vacuum pump (not shown). A portion of the drum surface which has been subjected to water separation treatment by means of nozzles (9, 9*a*, 9*b*) is substantially free from water deposited thereon and thus is ready to act as an impact body for particles to collide therewith. Both types of blower nozzles (9*a*) and suction nozzles (9*b*) may be used in a single apparatus, in which case the air drawn through the suction nozzle (9*b*) can be used for the blower nozzle (9*a*), thereby maintaining a substantially pressure in the housing (10).

For the purpose of water separation from the drums, it is also advantageous that a plurality of grooves (notches) or slits are formed on the periphery of each drum (1*a*, 2, 3). More particularly, the water deposited on a rotating drum tends to move around the drum and therefore would be difficult to remove therefrom. The provision of the notches or slits will prevent such slippery movement of the water around the drum and promote water separation. The notches or slits are substantially formed in the axial direction of the drum, with a uniform spacing interval provided between adjacent notches or slits. In practice, at least three notches or slits should be formed at 120 degree intervals, but more preferably, four to six notches or slits can be provided at 60 to 90 degrees intervals for increasing the frequency of water separation.

Figure 8:
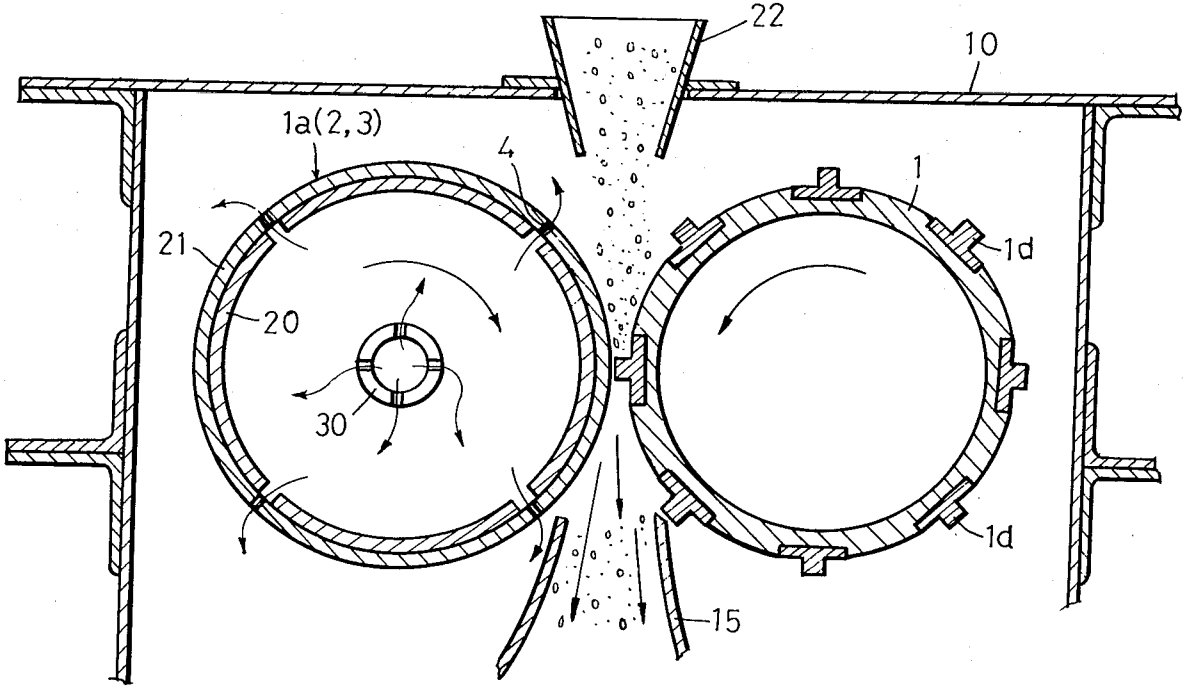
FIG. 8 is a partial sectional view showing a pair of the rotary drums of FIG. 2 or 3 which is provided with a plurality of axially elongating slits.

When the drum is provided with a plurality of slits, air flow is obtained at the slit utilizing a centrifugal force created by the rotation of the drum, thereby improving the water separation effect. More particularly, as shown in FIG. 8, air is caused to flow from the inside to the outside of the drum (1*a*) through the respective slits (4), whereby the deposited water is removed. Although not shown in FIG. 8, it will be understood that slits should also be formed on the peripheries of the drums (2, 3) in the same manner.

Figure 9:
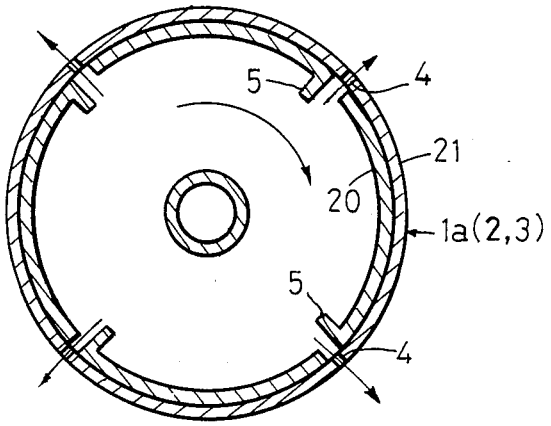
FIG. 9 is a cross-sectional view showing a modified embodiment of the drum shown in FIG. 8.
Figure 10A:
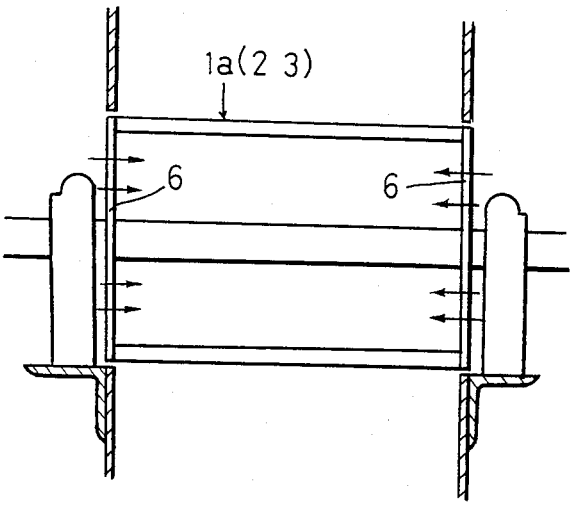
FIGS. 10A and 10B and 11A and 11B are sectional views showing still other embodiments of the drum shown in FIG. 8.
Figure 10B:
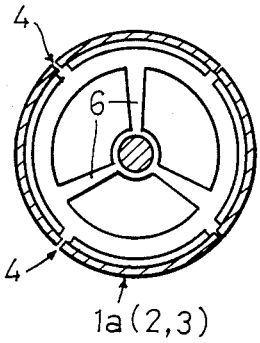
Figure 11A:
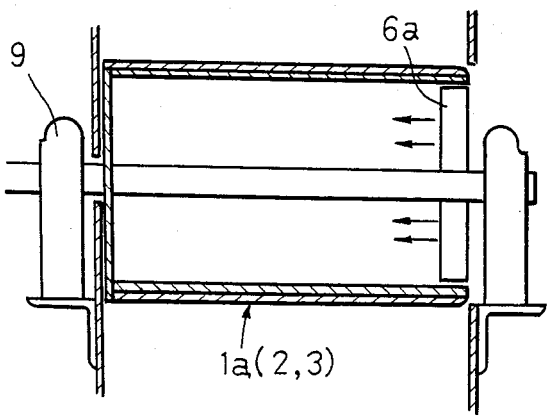
Figure 11B:
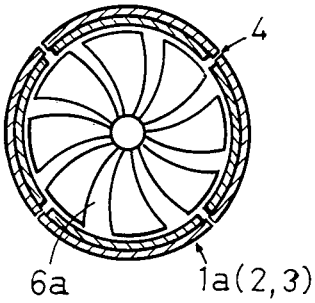

In another embodiment shown in FIG. 9, a plurality of radially inwardly projecting barriers (5) are formed integral with an inner segment (20) of the drum, which is positioned at the rearward side of the slits (4) in the rotational direction respectively, thereby assisting in the passage of the airflow through the respective slits (4).

As described above, the respective drums (1, 1*a*, 2, 3) should preferably comprises an inner base drum (20) and an overlying outer drum (21) as already shown in FIG. 8 or 9. The base drum (20) should be made of a steel plate or any other suitable material having a high toughness and strength, whereas the outer drum (21) should be of a casted steel or ceramics or the like having a high resistance to abrasion. Any suitable means may be used for combining the outer and inner drums (20, 21) together, but in any event the outer surface of the drum (21) should be kept smooth. Each drum (20, 21) may be divided into a plurality of segments, in which case the slits (4) are formed between two adjacent segments.

The advantage of increasing the air quantity ejected through the slits (4) can be obtained according to another embodiment of the drum shown in FIGS. 10A, 10B, or 11A, 11B. More particularly, a plurality of inclined radial vanes (6) (FIGS. 10A, 10B) or propellers (6*a*) (FIGS. 11A, 11B) are provided on both sides of the respective drums (1*a*, 2, 3) for introducing the open air into the drums. The numeral (9) denotes a pair of bearings for the drum.

When the rotating axis of the drum is made in the form of a hollow pipe (30) having a plurality of slits (30*a*) (FIG. 8) and is connected to a pressure source (not shown), it will also be possible to increase the air quantity. Such a hollow axis (30) can be used in the embodiment of FIGS. 9, 10A, 10B or 11A, 11B.

Figure 12A:
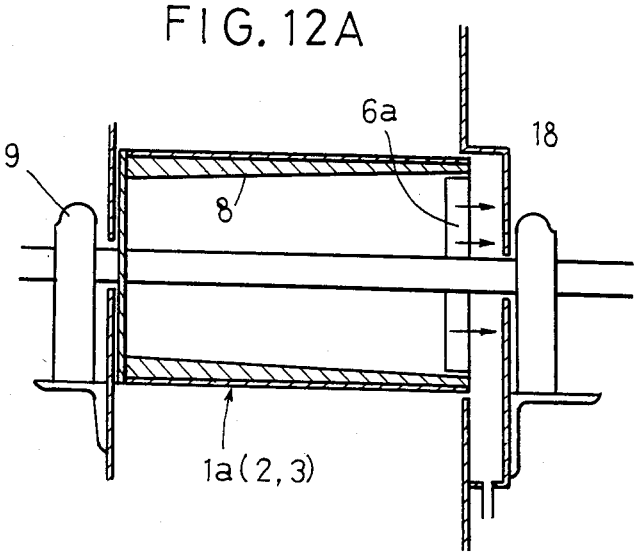
FIGS. 12A and 12B are longitudinal and cross sectional views showing still another embodiment of the drum to be used when the suction nozzle as shown in FIGS. 6 and 7 is adopted.
Figure 12B:
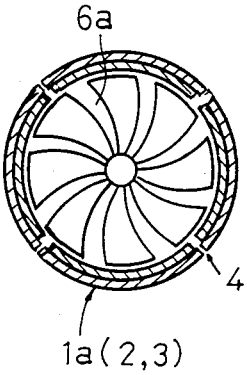

When desired, the slits (4) may be so designed that the air is introduced into the drum therethrough. More particularly, the hollow axis (30) can be connected to a vacuum means in FIG. 8 and the barriers (5) can be positioned at the forward edge of the respective slits (4) with respect to the rotational direction of the drum. In the embodiment of FIGS. 10A, 10B or 11A, 11B, the vanes or propellers are inclined in the opposite direction. In these cases it will become necessary to discharge the water to the outside of the drum, which has been introduced into the drum together with the air flow. For this purpose, the embodiment of the drum shown in FIGS. 11A, 11B can be modified as shown in FIGS. 12A, 12B, by way of example. The inner wall (8) of the hollow drum is shaped to be substantially conical as shown, that is the inner sectional area of the drum is reduced for facilitating the discharge of water toward the opening of the drum, and a receptacle (18) is attached to the housing to entirely cover the opening of the drum, thereby receiving the discharged water.

If necessary, an air inlet and an air outlet may be provided for the housing (10) so that air circulation is established within the housing (10).

The revolution of the drums (2, 2) should be determined taking into account the quantity of particles to be treated, the desired water quantity to remain on the particles after treatment and the diameter of the drum. For example, satisfactory results were obtained when using the drums (2, 2) having a diameter of 265 mm and rotating the same at 1,000 to 3,000 rpm. The auxiliary drum (3) may be rotated at the same revolution but may be rotated much more slowly than the main drums (2, 2), for example at 250 to 500 rpm.

A pair of drums (2, 2) are preferably disposed symmetrical with respect to the falling path of the particles projected by the drums (1, 1*a*), whereas the auxiliary drum (3) should be eccentrically positioned so that a portion thereof will cross the falling path of the particles to some extent, that is for example 20 to 120 mm and particularly 35 to 100 mm.

The particles of fine aggregate supplied from the hopper (22) should have an initial surface water in a quantity larger than the predetermined amount. The inventors confirmed that when sand particles having initial surface water in the quantity larger than 2 to 5 times of a slump value measured according to JIS (Japanese Industrial Standard) A1109, are treated according to the present invention, then the water quantity remaining on the particles after treatment can be adjusted to substantially a constant value. On the contrary, when treating sand particles which do not satisfy the above prescribed minimum requirement of initial surface water, the resulting water content after treatment will vary and thus is not always reliable.

Thus, in so far as the particles to be treated meet the above prescribed minimum requirement of initial surface water, the water quantity after treatment can be uniformly adjusted. However, the treatment of too high a quantity of initial surface water is not only uneconomic but also disadvantageous in practice. For example, it would become difficult to remove the large quantity of water deposited on the drum, thereby adversely affecting the results of the treatment according to the present invention. Thus, the upper limit of the initial surface water the particles should preferably be about 10 times of the slump value. However, where the particles to be treated contain harmful materials, for example sea sands including salt, a substantial quantity of water may be used to spray onto the particles so that such harmful materials can also be removed as a result of collision against the drums.

To have better understanding of the invention, the following example is given.

EXAMPLE

Figure 13:
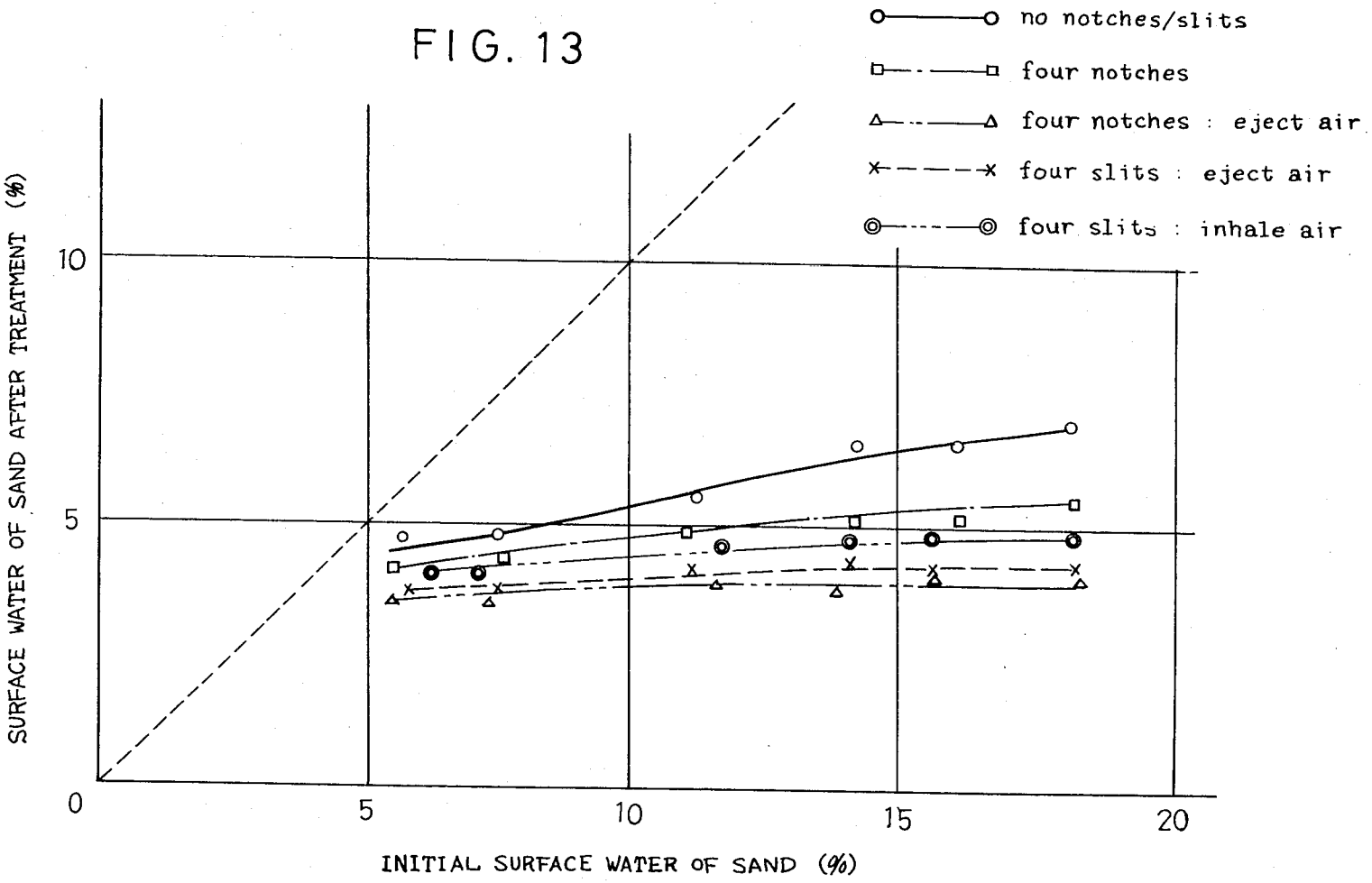
FIG. 13 is a graph showing the results of water removal by the apparatus according to the present invention.

Sand particles of middle size having an initial surface water content 2.5 to 8 times of the slump value were introduced into a housing, and treated by a pair of drums (1, 1*a*) having a diameter of 500 mm and rolling at 1,160 rpm and by drums (2, 2, 3) each rolling at 820 rpm. FIG. 13 shows the results of measurement of the percentage of water deposited on the surface of the sand particles which were treated by using various types of drums. As shown, the water quantity of the particles could not be sufficiently reduced according to the treatment using drums with no notches or slits, but satisfactory results can be obtained in the respective cases where drums having four notches were used, where air was blown against drums having four notches, where air was blown against drums having four slits and where air was drawn into drums having four slits, that is, according to the invention. The four notches or slits were formed on the periphery of each drum along the axial direction thereof at 90 degree intervals.

As many different embodiments of the present invention may be made without departing from the spirit and scope thereof, it is to be understood that the invention is not limited to the specific embodiments thereof except as defined in the appended claims.

What is claimed is:

1. A method for adjusting the quantity of water deposited on particles of fine aggregate which comprises supplying said particles having a quantity of initial surface water larger than a predetermined quantity, projecting said particles at a given velocity against at least one rotating surface, causing said particles to collide against said surface whereby a portion of the quantity of said initial surface water is removed and transferred from said particles and onto the rotating surface, removing the water collected on the rotating surface, and recovering the particles which have been treated having a uniform and optimum quantity of surface water.

2. An apparatus for adjusting the quantity of water deposited on particles of fine aggregate comprising means for supplying said particles of initial surface water larger than a predetermined quantity; means for imparting velocity energy to said particles to project said particles in a predetermined direction; at least one rotating cylindrical member arranged such that said particles projected in said predetermined direction are caused to collide against the surface thereof, thereby removing a portion of the quantity of said initial surface water from said particles and to the surface of said cylindrical member, means for removing the water collected on the surface of said cylindrical member utilizing centrifugal force created by the rotation of said cylindrical member; and means for recovering said particles which have been treated having a uniform and optimum quantity of surface water.

3. The apparatus according to claim 2 wherein said energy imparting means comprises a pair of drums rotating in an opposite direction with respect to each other, between which said particles are introduced to be projected vertically downwardly.

4. The apparatus of claim 3 wherein said at least one cylindrical member comprises a pair of spaced apart drums rotating in an opposite direction with respect to each other and disposed symmetrically with respect to the vertical projecting path of said particles.

5. The apparatus according to claim 4 wherein said cylindrical members further comprise an auxiliary drum disposed beneath said pair of drums so that a portion of said particles which may pass between said pair of drums with no contact therewith are caused to collide against said auxiliary drum.

6. The apparatus according to claim 2 which further comprises means for removing from said cylindrical members water deposited thereon within one complete rotation of said cylindrical member.

7. The apparatus according to claim 6 wherein said water removing means comprises a plurality of notches formed on the periphery of said cylindrical members in the longitudinal direction thereof.

8. The apparatus according to claim 6 wherein said water removing means comprises a plurality of slits formed on the periphery of said cylindrical member in a longitudinal direction thereof.

9. The apparatus according to claim 6 wherein said water removing means comprises one or more of nozzle means for establishing an air flow condition at the periphery of said cylindrical members.

10. The apparatus according to claim 9 wherein said nozzle means comprises an air blower for blowing air against said periphery of said chlindrical member at the point positioned substantially opposite to a point of collision between said particles and said cylindrical member.

11. The apparatus according to claim 9 wherein said nozzle means comprises an air vacuum means for drawing air from said periphery of said cylindrical members at a point positioned substantially opposite to a point of collision between said particles and said cylindrical member.

12. The apparatus according to claim 11 which further comprises a water receiver for receiving water absorbed by said vacuum means from said periphery of said cylindrical member.

13. The apparatus according to claim 7 wherein said water removing means further comprises at least one nozzle means for establishing air flow condition at a periphery of said cylindrical member.

14. The apparatus according to claim 13 wherein said nozzle means comprises an air blower for blowing air against the periphery of said cylindrical member at a point positioned substantially opposite to the point of collision between said particles and said cylindrical member.

15. The apparatus according to claim 13 wherein said nozzle means comprises an air vacuum means for inhaling air from the periphery of said cylindrical members at a point positioned substantially opposite to the point of collision between said particles and said cylindrical member.

16. The apparatus according to claim 8 wherein an inner surface of the periphery of said cylindrical member is provided with a plurality of inwardly projecting barriers disposed in the vicinity of the respective slits.

17. The apparatus according to claim 8 wherein said cylindrical member is provided with propeller means disposed at the open end thereof for introducing air into said cylindrical member.

18. The apparatus according to claim 8 wherein said cylindrical member is provided with propeller means disposed at the open end thereof for discharging air introduced into said cylindrical member through said slits.

19. The apparatus according to claim 2 wherein said cylindrical member is rotated about a hollow axis having a plurality of apertures formed on the periphery of said axis in the longitudinal direction thereof.

20. The apparatus according to claim 1 which further comprises guide means for guiding water which has been separated from said particles to prevent said water from entering the falling path of said particles.

21. The apparatus according to claim 8 wherein said water removing means further comprises one or more of nozzle means for establishing air flow condition at a periphery of said cylindrical member.

* * * * *